US005851238A

United States Patent [19]

Gadoury et al.

[11] Patent Number: 5,851,238

[45] **Date of Patent: *Dec. 22, 1998**

[54] PHOTOCHEMICALLY STABILIZED POLYAMIDE COMPOSITIONS

[75] Inventors: Dean R. Gadoury, Asheville; Bobby J. Bailey, Candler, both of N.C.

[73] Assignee: BASF Corporation, Mt. Olive, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 690,692

[22] Filed: Jul. 31, 1996

[51] Int. Cl.[6] ..... D06P 3/06

[52] U.S. Cl. ..... 8/442; 8/490; 8/568; 8/673; 8/680; 8/685; 8/539; 8/924

[58] Field of Search ..... 8/490, 568, 673, 8/680, 685, 442, 539, 924; 528/310–318

[56] References Cited

U.S. PATENT DOCUMENTS

| | | | |
|---|---|---|---|
| 4,756,947 | 7/1988 | Nishikawa et al. | 428/151 |
| 4,874,391 | 10/1989 | Reinert | 8/442 |
| 5,280,088 | 1/1994 | Gambale et al. | 525/433 |
| 5,466,761 | 11/1995 | Scheetz et al. | 525/432 |
| 5,484,460 | 1/1996 | Loeffler et al. | 8/638 |
| 5,487,856 | 1/1996 | Saraf | 264/78 |
| 5,489,639 | 2/1996 | Faber et al. | 524/417 |
| 5,494,492 | 2/1996 | Himeno et al. | 8/639 |
| 5,578,731 | 11/1996 | Ravichandran et al. | 546/247 |
| 5,595,701 | 1/1997 | MacGregor | 264/255 |
| 5,618,909 | 4/1997 | Lofquist et al. | 528/310 |
| 5,627,228 | 5/1997 | Kobayashi | 524/127 |

FOREIGN PATENT DOCUMENTS

| | | |
|---|---|---|
| 0466647A1 | 1/1992 | European Pat. Off. . |
| 0516192A2 | 12/1992 | European Pat. Off. . |
| 0546993A1 | 6/1993 | European Pat. Off. . |
| 2642764 | 8/1990 | France . |
| 2642461 A1 | 3/1978 | Germany . |
| 3823112A1 | 1/1990 | Germany . |
| 3901717 A1 | 7/1990 | Germany . |
| 19537614A1 | 4/1997 | Germany . |
| 9-41217 | 2/1997 | Japan . |
| 9-41218 | 2/1997 | Japan . |
| 670588 | 6/1979 | U.S.S.R. . |
| 2 220 418 | 1/1990 | United Kingdom . |
| WO 90/09408 | 8/1990 | WIPO . |
| 0050/44840 | 10/1995 | WIPO . |
| WO 97/05189 | 2/1997 | WIPO . |

*Primary Examiner*—Margaret Einsmann

[57] ABSTRACT

A process for preparing photochemically stable dyed nylon compositions includes providing to a dyebath a shaped article of poly(epsilon-caprolactam) hydrolytically polymerized in the presence of water, a carboxylic acid chain regulator and a hindered piperidine derivative; and in the dyebath, dyeing the shaped article with one or more metalized or nonmetalized acid dyestuffs.

12 Claims, 4 Drawing Sheets

| | BS403F/4180 | BV403N/4180 | BS403F/4980 | BV403N/4980 | BS403F/5880 | BV403N/5880 |
|---|---|---|---|---|---|---|
| OZONE | 1.3 | 1.3 | 0.8 | 1 | 0.8 | 0.5 |
| NOx | 1.2 | 1 | 0.6 | 0.7 | 0.3 | 0.7 |
| XENON LIGHT | 9.2 | 4.2 | 8.3 | 4.8 | 9.8 | 4.1 |

POLYMER /SPINNING SPEED

| | BS403F/4180 | BV403N/4180 | BS403F/4980 | BV403N/4980 | BS403F/5880 | BV403N/5880 |
|---|---|---|---|---|---|---|
| OZONE | 0.5 | 0.3 | 0.3 | 0.4 | 0.3 | 0.4 |
| NOx | 0.3 | 0.4 | 0.3 | 0.3 | 0.2 | 0.3 |
| XENON LIGHT | 3.7 | 3.9 | 3.6 | 4.1 | 3.8 | 4 |

POLYMER /SPINNING SPEED

| | BS403F/4180 | BV403N/4180 | BS403F/4980 | BV403N/4980 | BS403F/5880 | BV403N/5880 |
|---|---|---|---|---|---|---|
| OZONE | 3.8 | 3.9 | 3.9 | 3.6 | 4 | 3.7 |
| NOx | 2 | 1.5 | 1.9 | 1.4 | 1.8 | 1.5 |
| XENON LIGHT | 18.3 | 12.4 | 18.3 | 11.9 | 18.3 | 12.4 |

POLYMER /SPINNING SPEED

| | BS403F/4180 | BV403N/4180 | BS403F/4980 | BV403N/4980 | BS403F/5880 | BV403N/5880 |
|---|---|---|---|---|---|---|
| OZONE | 3.3 | 3.4 | 3.2 | 3.3 | 3.7 | 3.4 |
| NOx | 1.6 | 1.3 | 1.3 | 1.3 | 1.5 | 1.3 |
| XENON LIGHT | 13.4 | 12.5 | 13.9 | 12.1 | 14.3 | 12.4 |

POLYMER /SPINNING SPEED

STABILITY TO XENON LIGHT
METALIZED DYES /NO STABILIZER

| | 0 kJ | 112 kJ | 188 kJ | 225 kJ | 300 kJ |
|---|---|---|---|---|---|
| BS403F / 4180 ● | 100 | 62.3 | 46.2 | 40 | 26.9 |
| BV403N/ 4180 + | 100 | 93.3 | 79.6 | 67.8 | 62.7 |
| BS403F / 4980 ✳ | 100 | 73.2 | 47.8 | 36.6 | 27.1 |
| BV403N/ 4980 ■ | 100 | 82.9 | 71.4 | 65.7 | 58.3 |
| BS403F / 5880 ✳ | 100 | 71.9 | 49.2 | 41.7 | 33.9 |
| BV403N/ 5880 ◇ | 100 | 83 | 63.9 | 62.9 | 57.2 |

POLYMER TYPE /SPIN SPEED

STABILITY TO XENON LIGHT
METALIZED DYES WITH STABILIZER

| | 0 kJ | 112 kJ | 188 kJ | 225 kJ | 300 kJ |
|---|---|---|---|---|---|
| BS403F / 4180 ● | 100 | 95.7 | 82.7 | 77.6 | 67.3 |
| BV403N/ 4180 + | 100 | 92.1 | 76 | 68.9 | 59.1 |
| BS403F / 4980 ✳ | 100 | 99 | 83.7 | 77.4 | 68.5 |
| BV403N/ 4980 ■ | 100 | 90.9 | 74.8 | 61.6 | 56 |
| BS403F / 5880 ✳ | 100 | 93 | 74.4 | 71.1 | 65.8 |
| BV403N/ 5880 ◇ | 100 | 86.9 | 68.8 | 63.8 | 56.3 |

POLYMER TYPE /SPIN SPEED

STABILITY TO XENON LIGHT
NONMETALIZED DYES /NO STABILIZER

| | 0 kJ | 112 kJ | 188 kJ | 225 kJ | 300 kJ |
|---|---|---|---|---|---|
| BS403F / 4180 ● | 100 | 49.2 | 25.5 | 16.7 | 6.1 |
| BV403N/ 4180 + | 100 | 70.1 | 50.8 | 39 | 26.5 |
| BS403F / 4980 ✳ | 100 | 46 | 24.6 | 17.8 | 5.8 |
| BV403N/ 4980 ■ | 100 | 77.1 | 55.8 | 45.5 | 34.1 |
| BS403F / 5880 ✳ | 100 | 47.2 | 25.6 | 17.8 | 7.6 |
| BV403N/ 5880 ◇ | 100 | 71.5 | 56.1 | 43.1 | 30.9 |

POLYMER TYPE /SPIN SPEED

STABILITY TO XENON LIGHT
METALIZED DYES WITH STABILIZER

| | 0 kJ | 112 kJ | 188 kJ | 225 kJ | 300 kJ |
|---|---|---|---|---|---|
| BS403F / 4180 ● | 100 | 73.8 | 52.9 | 44.1 | 33 |
| BV403N/ 4180 + | 100 | 74.1 | 55.6 | 39.5 | 26 |
| BS403F / 4980 ✳ | 100 | 73.2 | 55.5 | 44.9 | 30.8 |
| BV403N/ 4980 ■ | 100 | 77.9 | 56.7 | 46.1 | 27.5 |
| BS403F / 5880 ✳ | 100 | 71.9 | 54.7 | 42.3 | 28.7 |
| BV403N/ 5880 ◇ | 100 | 72.7 | 54.5 | 44.6 | 28.1 |

POLYMER TYPE /SPIN SPEED

PHOTOCHEMICALLY STABILIZED POLYAMIDE COMPOSITIONS

FIELD OF THE INVENTION

This invention relates to dyed polyamide compositions having superior photochemical stability and especially to such polyamide compositions when they are nylon 6 fibers.

BACKGROUND OF THE INVENTION

It is known that some polyamide (nylon) compositions are susceptible to degradation by light and heat The stabilization of nylon polymers against such degradation has been the subject of considerable developmental effort improved light and heat stability of nylon polymers results from incorporating additives into the host polymer before shaping. One such class of additive stabilizers is the hindered amine light stabilizer class which includes compounds derived from polyalkylpiperidine. Exemplary polyalkylpiperidine derivative additives, that may be either inert to or reactive with the polymer to be stabilized, are described in: USSR Patent Application S.U. 670588, published Jun. 30, 1979; German Patent No. DE 3823112A1, laid open Jan. 11, 1990; PCT Patent Application WO 90/09408, published Aug. 23, 1990; French Patent No. 2,642,764, published Aug. 10, 1990; and European Patent Publication No. 0516192A2, published Dec. 2, 1992. Such hindered amine additives have been described to enhance dyeability of polyamides in German Patent No. 3,901,717A1, laid open Jul. 26, 1990.

2,2,6,6-tetra-alkylpiperidine [CAS 768-66-1] derivatives polymerized with caprolactam have been used as heat and light stabilizers for other polymers. German Patent No. 2,642,461 laid open Mar. 30, 1978, describes such a stabilizer, preferably for use with polyurethanes.

Nylon polymers have also been stabilized by incorporating stabilizing materials directly into the polymer chain. For example, epsilon-caprolactam may be polymerized in the presence of water, carboxylic acids and hindered piperidine derivatives (polyalkylpiperidines) to form a modified nylon 6 polymer that is stabilized against heat and light degradation. Such a stabilized polymer is described in PCT Application WO 95/28443 published Oct. 26, 1995.

Polyalkylpiperidine derivatives have been used in dyebaths for various purposes. UK Patent No. GB 2 220 418A, published Jan. 1, 1990, describes dyestuff salts of hindered amine radicals, (including certain 2,2,6,6-tetramethyl (piperidine radicals)) and anionic dyestuff radicals providing polyamide dyeings that are colorfast and that exhibit good wet fastness (especially washfastness). European Patent Application No. 0546993A1, published Jun. 16, 1993, describes hindered amine heat and light stabilizers for polyamide fibers that are applied in an aqueous bath, such as a dyebath. European Patent Application 0466647A1, published Jan. 15, 1992, describes hindered amine heat and light stabilizers for dyed and undyed polyamide fiber materials. These stabilizers are applied from an aqueous bath before, during or after dyeing to increase the heat and light stability of the fibers and dyes, including metalized acid dyes.

Although the stabilizers, either as additives or as components of the polymer chain, do much to stabilize the polymer itself against heat and light, such additives do very little to stabilize the materials with which such polymers are commonly treated. For example, nylon polymers in the shaped form are commonly dyed with dyes. Such dyes suffer from a tendency to fade or change color in the presence of light and heat Fading is particularly noticeable when the dyed article is exposed to intense light, heat and moisture. Dyed fibers used for automotive headliners and carpeting are particularly susceptible to fading because of intense exposure to the sun, heat and moisture.

SUMMARY OF THE INVENTION

It has now been surprisingly discovered that when nylon 6, made by polymerizing epsilon-caprolactam in the presence of water as an initiator, a carboxylic acid chain regulator and a hindered piperidine derivative, is dyed with metalized or nonmetalized acid dyestuffs, such dyed nylon 6 articles exhibit greatly enhanced resistance to photochemical degradation of the dyestuff and polymer.

It is an object of this invention to provide photochemically stabilized dyed nylon 6 articles.

Related objects and advantages will become apparent to the ordinarily skilled after reading the following detailed description.

DETAILED DESCRIPTION OF THE PREFERRED EMBODIMENTS

Figure 1:
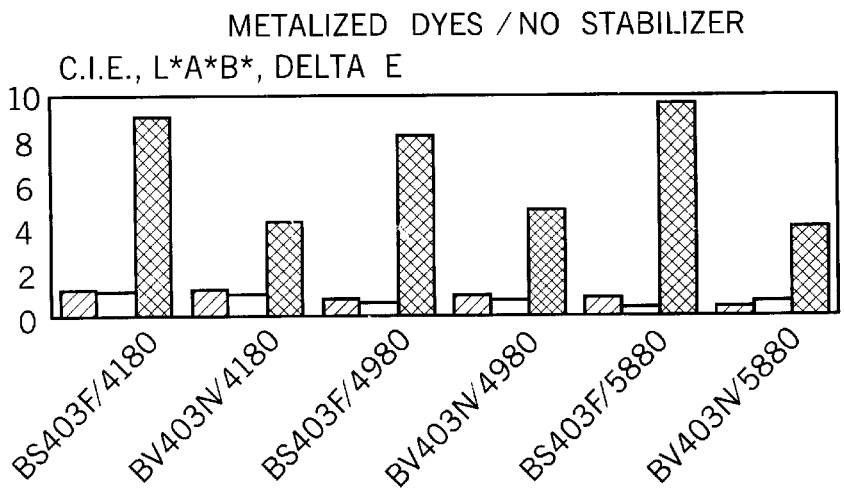
FIG. 1 is a bar chart showing comparative light stability of fibers dyed with metalized acid dyes according to the present invention versus conventional fibers.

To promote an understanding of the principles of the present invention, descriptions of specific embodiments of the invention follow and specific language is used to describe them. It will nevertheless be understood that no limitation of the scope of the invention is intended by the use of specific language. Alterations, further modifications and such further applications of the principles of the invention discussed are contemplated as would normally occur to one ordinarily skilled in the art to which the invention pertains.

The present invention is a process for preparing photochemically stable dyed nylon compositions. This process involves providing a shaped nylon article to a dyebath and dyeing the shaped article with metalized acid dyestuffs, nonmetalized acid dyestuffs or combinations thereof.

The nylon used to make the articles is made by hydrolytically polymerizing epsilon-caprolactam in the presence of water, a carboxylic add chain regulator and a hindered piperidine derivative. Specifically, the nylon may be made by polymerizing epsilon-caprolactam in the presence of at least one hindered amine (piperidine) compound of the formula:

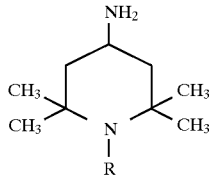

in which R represents hydrogen, hydrocarbon groups having 1 to 20 C atoms and, preferably, alkyl groups having 1 to 18 C atoms; or benzene. The hindered piperidine derivative is preferably an amino polyalkylpiperidine. Preferably, the hindered piperidine derivative is 2,2,6,6-tetraalkylpiperidine. Exemplary hindered piperidine compounds include:

4amino-2,2',6,6'-tetramethylpiperidine;
4-(aminoalkyl)-2,2',6,6'-tetramethylpiperidine;
4-(aminoaryl)-2,2',6,6'-tetramethylpiperidine;
4-(aminoaryl/alkyl)-2,2'6,6'-tetramethylpiperidine;
3-amino-2,2',6,6'-tetramethylpiperidine;
3-(aminoalkyl)-2,2',6,6'-tetramethylpiperidine;
3-(aminoaryl)-2,2'6,6'-tetramethylpiperidine;
3-(aminoaryl/alkyl)-2,2',6,6'-tetramethylpiperidine;
2,2',6,6'-tetramethyl-4-piperidinecarboxylic acid;
2,2',6,6'-tetramethyl-4piperidinealkylcarboxylic acid;
2,2',6,6'-tetramethyl-4-piperidinearylcarboxylic acid;
2,2',6,6'-tetramethyl4piperidinealkyl/arylcarboxylic acid;
2,2',6,6'-tetramethyl-3piperidinecarboxylic acid;
2,2',6,6'-tetramethyl-3-piperidinealkylcarboxylic acid;
2,2',6,6'-tetramethyl-3-piperidinearylcarboxylic acid; and
2,2',6,6'-tetramethyl-3-piperidinealkyl/arylcarboxylic acids.

The hindered amine compound is added to the starting monomers or to the polymerizing reaction mixture. The polymerization is preferably carried out according to conventional conditions for polymerizing caprolactam to make nylon 6. The hindered amine compound is added to the starting monomers in an amount of 0.03 to 0.8 mol %, preferably from 0.06 to 0.4 mol %, each in relation to 1 mol amine groups of the polyamide.

The hindered amine compound may be combined with at least one of the conventional chain regulators. Suitable chain regulators are, for example, monocarboxylic acids such as acetic acid, propionic acid and benzoic acid. Dicarboxylic acid chain regulators may be selected from the group of $C_4$–$C_{10}$ alkane dicarboxylic acids (e.g., cyclohexane-1,4-dicarboxylic acid); benzene and naphthalene dicarboxylic acids (e.g., isophthalic acid, terephthalic acid and napththalene 2,6-dicarboxylic acid); and combinations thereof. Preferably the dicarboxylic acid chain regulator is terephthalic acid. The preferable amount of dicarboxylic acid used is from 0.06 to 0.6 mole % in relation to 1 mole amide groups.

The amount of chain regulator is selected according to the desired target amine end-group content of the end product and according to the desired target melt stability. The target amino end-group content is usually based on the desired dye affinity of the fibers. The target melt stability is based on the practical requirements for the processing of the products, for example, melt spinning.

Water is preferably used as a polymerization initiator. The amount of water used as an initiator may vary but is typically about 0.4 wt % based on the weight of the epsilon caprolactam monomer.

The modified, stabilized nylon polymer may be shaped according to any conventional shaping method such as molding, fiber spinning, etc. Preferably, the nylon polymer is spun into textile or carpet fibers. The remainder of this detailed description of the invention uses the preferable fiber form of the nylon polymer to assist in providing concrete examples to the ordinarily skilled. Those ordinarily skilled in the art will understand that the principles embraced by the discussion apply to other shaped forms of the polymer, too.

The shaped article is dyed with metalized or nonmetalized acid dyes. Dyeing may occur in fiber form as in stock dyeing of filament, staple, tow, tops, sliver or in fabric form such as woven, nonwoven or knitted goods or in garment form. The dyestuffs are preferably non-complexed acid or 1:2 metal complexed acid dyestuffs prepared with chrome, iron, cobalt, copper, aluminum or any transition metal. Other classes of dyestuffs may also be used, such as disperse, direct or reactive dyestuffs. Usual dyebath conditions for dyeing nylon can be employed.

The following general conditions are exemplary and not intended to be limiting. A dyebath is prepared at a volume equal to about 20 times the weight of the goods to be dyed. Processing chemicals are added including a chelating agent to prevent the deposition or complexing of metal ions in hard water, a dye leveling agent and, in the case of metalized acid dyes, an acid donor to slowly lower the dyebath pH. The dyestuff is added and the dyebath pH is adjusted from about 5 to about 7 for acid dyes and from about 8 to about 10 for metalized acid dyes. The solution is heated to the desired temperature of typically from about 95° C. to about 110° C. at a rate of from about 0.5° to about 3.0° C. per minute and held at that temperature for about 30 to about 60 minutes. The dyebath is cooled or emptied and the goods are thoroughly rinsed with fresh water. The dyed goods are dried in a vertical oven such as a Tenter, a tumble drier or passed over heater cans. The dyed goods can then be optionally heatset to improve dimensional stability.

Exemplary dyes useful in the practice of the present invention include nonmetalized dyes such as C.I. Acid Yellow 246; C.I. Acid Orange 156; C.I. Acid Red 361; C.I. Acid Blue 277; and C.I. Acid Blue 324; and metalized dyes such as C.I. Acid Yellow 59; C.I. Add Orange 162; C.I. Acid Red 51; C.I. Acid Blue 171; C.I. Acid Brown 298; C.I. Acid Black 131:1; and C.I. Acid Black 132.

Another aspect of the present invention is nylon articles made of nylon stabilized with a hindered piperidine derivative copolymerized with caprolactam and dyed with a metalized or nonmetalized acid dye. Preferably such articles are in fiber form. The method of making such articles and use of preferred components, dyes, etc., have already been described above.

The invention will be described by reference to the following examples. The examples are set forth by way of illustration, and are not intended to limit the scope of the invention. All percentages are percentages by weight unless otherwise noted. In the following examples, the photochemical stability of dyed yarns made according to the present invention is compared to dyed conventional yarns.

In the following examples, unless noted otherwise, the following methods are used to measure the stated properties.

Xenon Lightfastness 112.8,188.0,225.6, and 300.8 kJ. (SAE Method J1885) Accelerated Exposure, Water-Cooled Xenon-Arc Weather-Ometer.

Strength Stability to Xenon Light

ASTM Method D2256, with 5.0" gauge length, 10.0"/min cross head speed.

Ozone

Three cycles by AATCC Test Method 129-1990, *Colorfastness to Ozone in the Atmosphere Under High Humidities.*

Oxides of Nitrogen

Three cycles by AATCC Test Method 1641992, *Colorfastness to Oxides of Nitrogen in the Atmosphere Under High Humidities.*

Color Measurements

Color measurements are made using an Applied Color Systems (ACS) Spectrophotometer generating 1976 CIE LAB (D6500 illuminant, 10 degree observer) values. Delta E (ΔE, total color difference) calculations are made against unexposed controls. Details of CIE LAB measurements and calculation of total color difference (Delta E) are found in the color science literature, for example, Billmeyer and M. Saltzman, *Principles of Color Technology,* 2nd Edition. The higher the Delta E value, the greater the total color difference between the sample and the control. The higher the total color difference value (i.e., Delta E), the less stable the sample at the condition of exposure.

Relative Viscosity (RV)

Relative viscosity compares the viscosity of a solution of polymer in formic acid with the viscosity of the formic acid itself.

EXAMPLE 1

A. Yarn Production

Two different types of 40/12 round fiber cross-section semidull yarns are produced according to conventional nylon melt spinning techniques using a heat stabilized nylon 6 chip containing 0.5% terephthalate acid ("TPA") and 0.25% triacetone diamine (4amino-2,2',6,6'-tetramethylpiperidine) ("TAD") (referred to as "BV403N") (RV 2.4: 0.3% $TIO_2$) and a conventional nylon 6 chip ("BS403F") (RV 2.4: 0.3% $TIO_2$) both available from BASF Corporation, Mt Olive, N.J. The yarns are produced at various speeds and without induced drawing. The winding tension is maintained at 6 grams by adjusting winding speed. All samples are knitted into tubes and dyed. Table 1 presents the nylon properties. Table II presents the yarn properties at various process speeds.

The yarns are knitted into tubes and dyed three shades as described below with metalized acid dyes and three shades with non-metalized acid dyes both with and without Cibafast N-2 (UV stabilizer commercially available from Ciba Corporation, Greensboro, N.C.). These yarns are then heat-set after dyeing at 374° F. (190° C.) for 20 seconds.

B. Dyeing with Metalized Acid Dyes

20:1 bath ratio, demineralized water 0.25 g/l Versene® (EDTA chelating agent)

2.0% o.w.f Uniperol® NB-SE 2.0% o.w.f. Eulysin ®WP

| | |
|---|---|
| Shade 1 - Spruce | |
| 0.075% Intralan ® Bordeaux RLB 200 | (C.I. number not known) |
| 0.092% Intralan ® Yellow 2BRL-SM 250% | (C.I. number not known) |
| 0.057% Irgalan ® Yellow 2GL 250% | (C.I. Acid Yellow 59) |
| 0.342% Irgalan ® Blue 3GL 200 | (C.I. Acid Blue 171) |
| 1.010% Irgalan ® Grey GL | (C.I. Acid Black 131:1) |
| Shade 2 - Lt. Grey | |
| 0.059% Irgalan ® Yellow 3RL | (C.I. Acid Orange 162) |
| 0.123% Irgalan ® Blue 3GL 200 | |
| 0.062% Intralan ® Bordeaux RLB 200 | (C.I. number not known) |
| 0.034% Irgalan ® Grey GL 200 | |
| 0.030% Lanasyn ® Yellow LNW | (C.I. number not known) |
| Shade 3 - Burgundy | |
| 0.520% Irgalan ® Bordeaux EL 200 | (C.I. Acid Red 51) |
| 0.020% Irgalan ® Blue 3GL 200 | |
| 0.200% Irgalan ® Black RBL 200 | (C.I. Acid Black 132) |
| 0.660% Lanacron ® Brown S-GL | (C.I. Acid Brown 298) |

(Intralan® and Irgalan® dyestuffs are commercially available from Crompton & Knowles Corporation, Charlotte, N.C.; Lanacron® from Ciba Corporation, Greensboro, N.C.; and Lanasyn® from Sandoz Chemicals Corporation, Charlotte N.C.).

The bath pH is adjusted to 10.0 with soda ash. Samples are heated to 95° C. over 30 minutes and held at 95° C. for 30 minutes. The Eulysin® WP brings the pH down to 6–7 during the dyeing. Samples are rinsed in warm and cold water and dried. Tubes are subsequently post heatset at 190° C. for 20 seconds.

C. Dyeing With Nonmetalized Acid Dyes

20:1 bath ratio, demineralized water 1.0% Chemcogen AC (anionic leveling agent commercially available from Rhone-Poulenc, Inc., Lawrenceville, Ga. under the trade name Supralev®AC)

0.5 g/L Trisodium Phosphate 0.25 g/L Versene®

| | |
|---|---|
| Shade 1 - Gray | |
| 0.079% Tectilon ™ Orange 3G 100% | (C.I. Acid Orange 156) |
| 0.124% Tectilon ™ Red 2B 100% | (C.I. Acid Red 361) |
| 0.114% Telon ™ Blue BRL 200% | (C.I. Acid Blue 324) |
| Shade 2 - Blue | |
| 0.402% Tectilon ™ Yellow 3R 250% | (C.I. Acid Yellow 246) |
| 0.390% Tectilon ™ Red 2B 100% | |
| 1.1972% Tectilon ™ Blue 4R 100% | (C.I. Acid Blue 277) |
| Shade 2 - Burgundy | |
| 0.829% Tectilon ™ Yellow 3R 250% | |
| 2.064% Tectilon ™ Red 2B 100% | |
| 1.025% Tectilon ™ Blue 4R 100% | |

Tectilon ™ dyestuffs are commercially available from Ciba Corporation, Greensboro, NC, and Telon ™ dyestuffs from Miles Inc., Pittsburgh, PA)

The bath pH is adjusted to 5.8 with acetic acid. Samples are heated to 95° C. over 30 minutes and held at 95° C. for 30 minutes. Samples are rinsed in warm and cold water and dried. Tubes are subsequently post heatset at 190° C. for 20 seconds.

TABLE I

| NYLON 6 | BS403F (Comparative) | BV403N (Stabilized) |
|---|---|---|
| Chip Properties: | | |
| AEG (meq/kg) | 28.8 | 39.4 |
| RV | 2.42 | 2.45 |
| Dust (ppm) | 190 | 200 |
| Extract, % | 0.51 | 0.30 |
| $H_2O$, % | 0.04 | 0.04 |

AEG—Amine end groups

Extract.—Water extractable impurities.

TABLE II

| | | | Yarn Properties | | | | | |
|---|---|---|---|---|---|---|---|---|
| Example | Polymer Type | Process Speed (mm) | Denier | Elongation | Tenacity (gpd) | In. Mod (gpd) | B.W.S. % | Uster % CV |
| A | BS403F | 4180 | 40 | 56 | 4.31 | 16.5 | 8.0 | 0.5 |
| B | BS403F | 4980 | 40 | 54 | 4.60 | 16.5 | 7.5 | 0.5 |
| C | BS403F | 5880 | 40 | 51 | 4.73 | 18.0 | 7.4 | 0.5 |
| D | BV403N | 4180 | 40 | 60 | 4.53 | 16.5 | 8.6 | 0.6 |
| E | BV403N | 4980 | 41 | 56 | 4.88 | 16.8 | 8.1 | 0.5 |
| F | BV403N | 5880 | 41 | 51 | 5.18 | 17.7 | 7.4 | 0.5 |

Figure 2:
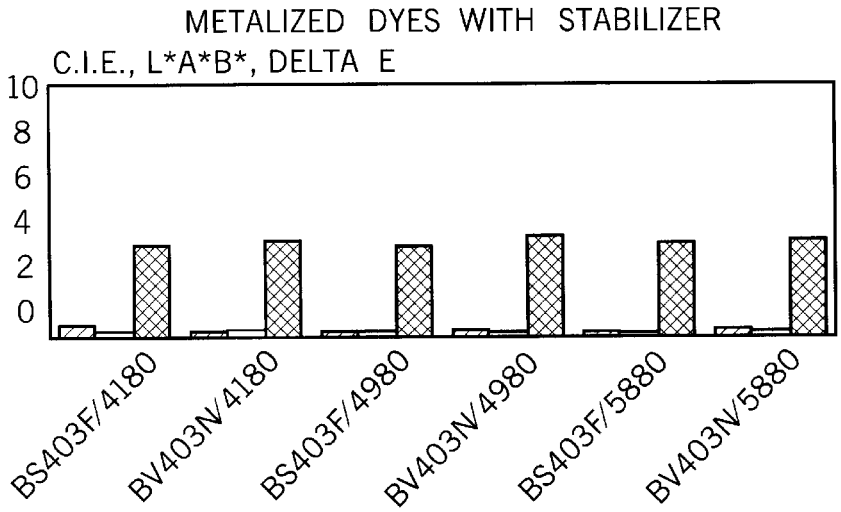
FIG. 2 is a bar chart showing light stability of fibers dyed with metalized acid dyes stabilized with a U.V. stabilizer in the dyebath.
Figure 3:
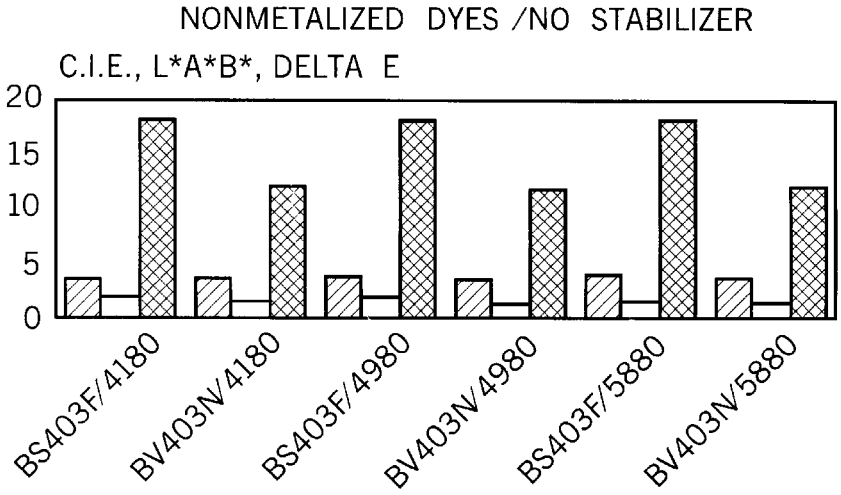
FIG. 3 is a bar chart showing comparative light stability of fibers dyed with nonmetalized acid dyes according to the present invention versus conventional fibers.
Figure 4:
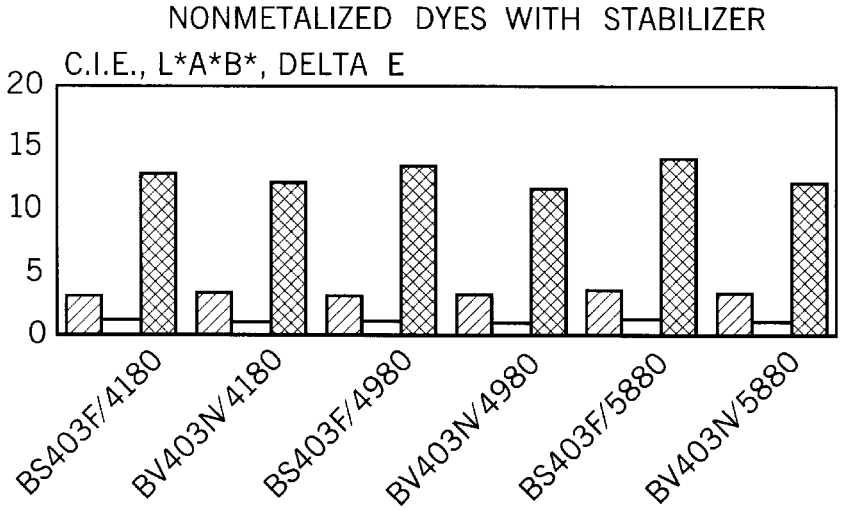
FIG. 4 is a bar chart showing light stability of fibers dyed with nonmetalized acid dyes with a U.V. stabilizer in the dyebath.

The dyed and knit yams are then tested for Xenon light fastness, ozone fastness, nitrogen oxide fastness and measured for total color change (ΔE) using a corresponding unexposed yarn as a control. The results for fastness to nitrogen oxides, ozone and light are presented in Tables III and IV and illustrated in FIGS. 1–4.

TABLE III

| | | Fastness Properties Metalized Acid Dyes - No UV Stabilizer CIE LAB, Delta E Values | | | | | | | | | | | | |
|---|---|---|---|---|---|---|---|---|---|---|---|---|---|---|
| Sample | Winding Speed | 1 Cycle Ozone | 2 Cycles Ozone | 3 Cycles Ozone | Avg. Ozone | 1 Cycle NOx | 2 Cycles NOx | 3 Cycles NOx | Avg. NOx | 112 kJ Xenon | 188 kJ Xenon | 225 kJ Xenon | 300 kJ Xenon | Avg. Xenon |
| Spruce | | | | | | | | | | | | | | |
| BS403F | 4180 | 0.6 | 2.0 | 0.8 | 1.1 | 1.5 | 0.2 | 0.6 | 0.8 | 3.8 | 6.9 | 8.5 | 11.3 | 7.6 |
| BV403N | 4180 | 0.3 | 1.5 | 1.8 | 1.2 | 0.2 | 2.1 | 2.0 | 1.4 | 1.6 | 3.3 | 3.7 | 5.1 | 3.4 |
| BS403F | 4980 | 0.5 | 0.5 | 0.6 | 0.5 | 0.3 | 0.5 | 0.4 | 0.4 | 4.3 | 7.2 | 7.9 | 10.9 | 7.6 |
| BV403N | 4980 | 0.5 | 0.4 | 2.4 | 1.1 | 0.1 | 0.1 | 0.2 | 0.1 | 3.3 | 4.7 | 5.0 | 6.4 | 4.9 |
| BS403F | 5880 | 0.4 | 0.4 | 0.5 | 0.4 | 0.3 | 0.5 | 0.3 | 0.4 | 4.3 | 6.2 | 7.9 | 10.4 | 7.2 |
| BV403N | 5880 | 0.1 | 0.2 | 0.2 | 0.2 | 0.4 | 0.6 | 0.2 | 0.4 | 3.1 | 4.7 | 5.2 | 7.0 | 5.0 |
| Grey | | | | | | | | | | | | | | |
| BS403F | 4180 | 0.9 | 0.8 | 1.3 | 1.0 | 2.5 | 2.4 | 0.6 | 1.8 | 8.8 | 16.3 | 18.7 | 22.0 | 16.5 |
| BV403N | 4180 | 1.3 | 0.6 | 2.0 | 1.3 | 1.4 | 1.5 | 1.5 | 1.5 | 4.0 | 5.7 | 6.6 | 8.4 | 6.2 |
| BS403F | 4980 | 0.6 | 0.7 | 0.7 | 0.7 | 1.1 | 1.0 | 0.6 | 0.9 | 6.3 | 12.3 | 14.4 | 19.9 | 13.2 |
| BV403N | 4980 | 2.4 | 2.1 | 0.8 | 1.8 | 1.9 | 1.8 | 1.6 | 1.8 | 4.5 | 6.1 | 6.9 | 8.0 | 6.4 |
| BS403F | 5880 | 0.3 | 2.4 | 2.4 | 1.7 | 0.4 | 0.2 | 0.3 | 0.3 | 11.0 | 18.0 | 20.8 | 22.7 | 18.1 |
| BV403N | 5880 | 1.3 | 1.1 | 1.3 | 1.2 | 1.7 | 1.6 | 1.4 | 1.6 | 2.2 | 4.3 | 4.8 | 6.4 | 4.4 |
| Burgundy | | | | | | | | | | | | | | |
| BS403F | 4180 | 1.6 | 1.5 | 1.9 | 1.7 | 0.1 | 1.1 | 1.7 | 1.0 | 2.3 | 2.5 | 4.4 | 5.0 | 3.6 |
| BV403N | 4180 | 0.4 | 1.9 | 1.8 | 1.4 | 0.1 | 0.1 | 0.3 | 0.2 | 2.1 | 3.2 | 3.0 | 4.2 | 3.1 |
| BS403F | 4980 | 0.3 | 1.5 | 1.4 | 1.1 | 1.3 | 0.2 | 0.2 | 0.6 | 3.1 | 3.6 | 4.1 | 5.5 | 4.1 |
| BV403N | 4980 | 0.1 | 0.4 | 0.3 | 0.3 | 0.4 | 0.3 | 0.3 | 0.3 | 2.5 | 3.0 | 3.4 | 4.2 | 3.3 |
| BS403F | 5880 | 0.1 | 0.2 | 0.2 | 0.2 | 0.3 | 0.2 | 0.2 | 0.2 | 2.4 | 3:8 | 4.3 | 5.5 | 4.0 |
| BV403N | 5880 | 0.2 | 0.2 | 0.2 | 0.2 | 0.1 | 0.0 | 0.2 | 0.1 | 1.8 | 3.1 | 3.4 | 3.5 | 3.0 |
| Spruce | | | | | | | | | | | | | | |
| BS403F | 4180 | 3.9 | 5.7 | 7.2 | 5.6 | 1.4 | 2.0 | 2.3 | 1.9 | 13.0 | 19.5 | 21.2 | 24.4 | 19.5 |
| BV403N | 4180 | 3.9 | 6.2 | 7.8 | 6.0 | 1.5 | 1.9 | 2.2 | 1.9 | 9.1 | 13.3 | 14.6 | 16.7 | 13.4 |
| B5403F | 4980 | 3.9 | 6.2 | 7.8 | 6.0 | 1.2 | 1.7 | 3.1 | 2.0 | 13.0 | 19.1 | 21.0 | 23.1 | 19.1 |
| BV403N | 4980 | 3.6 | 5.8 | 7.1 | 5.5 | 1.2 | 1.6 | 2.0 | 1.6 | 9.3 | 13.2 | 14.3 | 16.2 | 13.3 |
| BS403F | 5880 | 4.1 | 6.6 | 8.1 | 6.3 | 1.3 | 2.0 | 2.9 | 2.1 | 12.4 | 18.8 | 22.3 | 23.8 | 19.3 |
| BV403N | 5880 | 3.9 | 6.1 | 7.9 | 6.0 | 1.5 | 1.8 | 2.9 | 2.1 | 9.1 | 12.5 | 14.7 | 16.0 | 13.1 |
| Grey | | | | | | | | | | | | | | |
| BS403F | 4180 | 1.9 | 3.4 | 4.1 | 3.1 | 1.1 | 1.8 | 2.8 | 1.9 | 7.9 | 12.2 | 13.8 | 17.2 | 12.8 |
| BV403N | 4180 | 1.6 | 2.6 | 3.7 | 2.6 | 1.1 | 1.8 | 1.2 | 1.4 | 5.5 | 8.9 | 10.3 | 12.3 | 9.3 |
| BS403F | 4980 | 2.1 | 3.0 | 4.2 | 3.1 | 0.9 | 1.7 | 2.4 | 1.7 | 7.5 | 12.2 | 13.8 | 17.1 | 12.7 |
| BV403N | 4980 | 1.5 | 2.6 | 3.2 | 2.4 | 0.6 | 0.8 | 2.2 | 1.2 | 5.4 | 9.1 | 10.4 | 12.9 | 9.5 |
| BS403F | 5880 | 1.9 | 3.3 | 3.9 | 3.0 | 0.9 | 2.1 | 1.5 | 1.5 | 7.4 | 11.6 | 13.5 | 16.8 | 12.3 |
| BV403N | 5880 | 1.5 | 2.6 | 3.2 | 2.4 | 0.9 | 1.4 | 1.8 | 1.4 | 5.3 | 9.0 | 10.4 | 12.1 | 9.2 |
| Burgundy | | | | | | | | | | | | | | |
| BS403F | 4180 | 2.0 | 2.5 | 3.6 | 2.7 | 1.1 | 2.3 | 2.8 | 2.1 | 13.4 | 22.8 | 25.3 | 28.6 | 22.5 |
| BV403N | 4180 | 1.7 | 3.1 | 4.1 | 3.0 | 0.8 | 1.6 | 1.8 | 1.4 | 6.2 | 13.9 | 17.4 | 20.1 | 14.4 |
| BS403F | 4980 | 1.6 | 2.7 | 3.7 | 2.7 | 1.0 | 1.9 | 3.0 | 2.0 | 13.9 | 23.4 | 26.7 | 28.6 | 23.2 |
| BV403N | 4980 | 1.5 | 2.8 | 4.0 | 2.8 | 0.7 | 1.4 | 1.9 | 1.3 | 5.3 | 13.4 | 15.0 | 18.1 | 13.0 |

TABLE III-continued

| Sample | Winding Speed | 1 Cycle Ozone | 2 Cycles Ozone | 3 Cycles Ozone | Avg. Ozone | 1 Cycle NOx | 2 Cycles NOx | 3 Cycles NOx | Avg. NOx | 112 kJ Xenon | 188 kJ Xenon | 225 kJ Xenon | 300 kJ Xenon | Avg. Xenon |
|---|---|---|---|---|---|---|---|---|---|---|---|---|---|---|
| | | Fastness Properties Metalized Acid Dyes - No UV Stabilizer CIE LAB, Delta E Values | | | | | | | | | | | | |
| BS403F | 5880 | 1.7 | 2.8 | 3.9 | 2.8 | 0.8 | 1.7 | 2.8 | 1.8 | 15.0 | 23.4 | 26.1 | 28.4 | 23.2 |
| BV403N | 5880 | 1.6 | 2.6 | 3.7 | 2.6 | 0.5 | 1.2 | 1.7 | 1.1 | 7.3 | 14.0 | 17.1 | 21.0 | 14.9 |
| Spruce | | | | | | | | | | | | | | |
| BS403F | 4180 | 0.1 | 0.3 | 0.4 | 0.3 | 0.1 | 0.2 | 0.3 | 0.2 | 2.2 | 3.0 | 3.7 | 5.5 | 3.6 |
| BV403N | 4180 | 0.1 | 0.1 | 0.1 | 0.1 | 0.5 | 0.5 | 0.3 | 0.4 | 2.9 | 3.6 | 3.9 | 5.4 | 4.0 |
| BS403F | 4980 | 0.2 | 0.1 | 0.1 | 0.1 | 0.2 | 0.4 | 0.3 | 0.3 | 2.4 | 2.9 | 3.6 | 4.5 | 3.4 |
| BV403N | 4980 | 0.3 | 0.5 | 0.3 | 0.4 | 1.0 | 0.1 | 0.1 | 0.4 | 2.7 | 3.1 | 4.0 | 5.3 | 3.8 |
| BS403F | 5880 | 0.1 | 0.1 | 0.4 | 0.2 | 0.1 | 0.2 | 0.3 | 0.2 | 2.3 | 3.1 | 4.0 | 4.7 | 3.5 |
| BV403N | 5880 | 0.3 | 0.4 | 0.5 | 0.4 | 0.1 | 0.3 | 0.2 | 0.2 | 2.9 | 3.8 | 5.4 | 2.0 | 3.5 |
| Grey | | | | | | | | | | | | | | |
| BS403F | 4180 | 0.8 | 0.8 | 0.9 | 0.8 | 0.6 | 0.4 | 0.5 | 0.5 | 3.0 | 4.7 | 5.3 | 7.0 | 5.0 |
| BV403N | 4180 | 0.5 | 0.7 | 0.8 | 0.7 | 0.4 | 0.3 | 0.5 | 0.4 | 3.0 | 4.9 | 5.9 | 7.9 | 5.4 |
| BS403F | 4980 | 0.6 | 0.7 | 0.6 | 0.6 | 0.3 | 0.3 | 0.3 | 0.3 | 2.9 | 4.7 | 5.2 | 7.0 | 5.0 |
| BV403N | 4980 | 0.6 | 0.6 | 0.7 | 0.6 | 0.4 | 0.4 | 0.4 | 0.4 | 5.6 | 4.4 | 6.0 | 7.6 | 5.9 |
| BS403F | 5880 | 0.4 | 0.6 | 0.6 | 0.5 | 0.3 | 0.2 | 0.5 | 0.3 | 3.2 | 4.5 | 6.0 | 7.6 | 5.3 |
| BV403N | 5880 | 0.6 | 0.4 | 0.8 | 0.6 | 0.3 | 0.2 | 1.2 | 0.6 | 2.9 | 4.8 | 6.1 | 7.8 | 5.4 |
| Burgundy | | | | | | | | | | | | | | |
| BS403F | 4180 | 0.4 | 0.2 | 0.3 | 0.3 | 0.3 | 0.3 | 0.3 | 0.3 | 1.7 | 2.4 | 2.8 | 2.9 | 4.2 |
| BV403N | 4180 | 0.1 | 0.1 | 0.2 | 0.1 | 0.2 | 0.3 | 0.2 | 0.2 | 1.7 | 2.2 | 2.4 | 3.5 | 2.5 |
| BS403F | 4980 | 0.1 | 0.1 | 0.2 | 0.1 | 0.2 | 0.4 | 0.2 | 0.3 | 1.9 | 2.1 | 2.6 | 3.2 | 2.5 |
| BV403N | 4980 | 0.2 | 0.4 | 0.2 | 0.3 | 0.4 | 0.1 | 0.1 | 0.2 | 2.0 | 2.5 | 2.9 | 3.6 | 2.7 |
| BS403F | 5880 | 0.1 | 0.2 | 0.1 | 0.1 | 0.4 | 0.1 | 0.1 | 0.2 | 2.0 | 2.3 | 2.6 | 3.4 | 2.6 |
| BV403N | 5880 | 0.1 | 0.2 | 0.1 | 0.1 | 0.1 | 0.1 | 0.1 | 0.1 | 2.4 | 3.0 | 3.2 | 3.8 | 3.1 |
| Spruce | | | | | | | | | | | | | | |
| BS403F | 4180 | 2.8 | 4.8 | 5.5 | 4.4 | 0.8 | 1.4 | 2.1 | 1.4 | 10.3 | 13.6 | 14.6 | 15.9 | 13.6 |
| BV403N | 4180 | 3.2 | 4.7 | 6.0 | 4.6 | 0.8 | 1.3 | 1.9 | 1.3 | 10.9 | 13.8 | 15.3 | 17.5 | 14.4 |
| BS403F | 4980 | 3.3 | 2.0 | 6.7 | 4.0 | 0.8 | 1.4 | 2.1 | 1.4 | 10.2 | 13.8 | 15.2 | 17.1 | 14.1 |
| BV403N | 4980 | 3.0 | 4.8 | 6.3 | 4.7 | 0.7 | 1.2 | 1.9 | 1.3 | 9.9 | 15.1 | 15.2 | 16.6 | 14.2 |
| BS403F | 5880 | 3.2 | 5.0 | 7.1 | 5.1 | 0.9 | 1.6 | 1.8 | 1.4 | 10.8 | 14.3 | 15.6 | 16.9 | 14.4 |
| BV403N | 5880 | 3.0 | 5.2 | 6.3 | 4.8 | 0.8 | 1.4 | 1.7 | 1.3 | 10.6 | 14.2 | 15.3 | 17.8 | 14.5 |
| Grey | | | | | | | | | | | | | | |
| BS403F | 4180 | 2.0 | 3.1 | 3.6 | 2.9 | 1.0 | 2.4 | 2.1 | 1.8 | 5.4 | 8.5 | 10.1 | 12.5 | 9.1 |
| BV403N | 4180 | 1.6 | 2.9 | 3.7 | 2.7 | 0.7 | 0.8 | 2.5 | 1.3 | 5.3 | 8.6 | 10.6 | 12.5 | 9.3 |
| BS403F | 4980 | 1.7 | 2.9 | 4.3 | 3.0 | 0.9 | 1.7 | 1.4 | 1.3 | 5.8 | 8.7 | 9.7 | 12.2 | 9.1 |
| BV403N | 4980 | 1.6 | 2.5 | 3.3 | 2.5 | 1.1 | 0.8 | 1.9 | 1.3 | 5.6 | 8.7 | 10.5 | 13.4 | 9.6 |
| BS403F | 5880 | 1.8 | 2.9 | 4.1 | 2.9 | 1.1 | 1.3 | 2.9 | 1.8 | 6.2 | 9.2 | 10.5 | 13.2 | 9.8 |
| BV403N | 5880 | 1.5 | 2.7 | 3.6 | 2.6 | 0.5 | 0.9 | 1.6 | 1.0 | 5.5 | 8.7 | 10.7 | 13.1 | 9.5 |
| Burgundy | | | | | | | | | | | | | | |
| BS403F | 4180 | 1.6 | 2.5 | 3.5 | 2.5 | 1.4 | 1.4 | 1.7 | 1.5 | 7.8 | 17.5 | 19.9 | 24.3 | 17.4 |
| BV403N | 4180 | 1.8 | 3.0 | 4.1 | 3.0 | 0.5 | 1.4 | 2.0 | 1.3 | 6.4 | 12.9 | 16.1 | 19.6 | 13.8 |
| BS403F | 4980 | 1.4 | 2.6 | 3.6 | 2.5 | 0.8 | 1.2 | 1.8 | 1.3 | 9.0 | 18.9 | 21.3 | 24.9 | 18.5 |
| BV403N | 4980 | 1.9 | 2.7 | 3.6 | 2.7 | 0.6 | 1.3 | 1.9 | 1.3 | 4.8 | 11.9 | 14.2 | 19.6 | 12.6 |
| BS403F | 5880 | 1.7 | 3.0 | 4.1 | 2.9 | 0.6 | 1.4 | 1.9 | 1.3 | 9.4 | 19.1 | 21.9 | 24.0 | 18.6 |
| BV403N | 5880 | 1.9 | 3.0 | 3.9 | 2.9 | 0.8 | 1.4 | 2.6 | 1.6 | 4.9 | 12.3 | 16.0 | 20.0 | 13.3 |

TABLE IV

| Sample (winding speed) | Ozone | $NO_x$ | Xenon |
|---|---|---|---|
| | Fastness Properties Three Color Averages | | |
| Metalized Acid Dyes No UV Stabilizer | | | |
| BS403F (4180) | 1.3 | 1.2 | 9.2 |
| BV403N (4180) | 1.3 | 1.0 | 4.2 |
| BS403F (4980) | 0.8 | 0.6 | 8.3 |
| BV403N (4980) | 1.0 | 0.7 | 4.8 |
| BS403F (5880) | 0.8 | 0.3 | 9.8 |
| BV403N (5880) | 0.5 | 0.7 | 4.1 |

TABLE IV-continued

| Sample (winding speed) | Ozone | $NO_x$ | Xenon |
|---|---|---|---|
| | Fastness Properties Three Color Averages | | |
| 1.5% UV Stabilizer | | | |
| BS403F (4180) | 0.5 | 0.3 | 3.7 |
| BV403N (4180) | 0.3 | 0.4 | 3.9 |
| BS403F (4980) | 0.3 | 0.3 | 3.6 |
| BV403N (4980) | 0.4 | 0.3 | 4.1 |
| BS403F (5880) | 0.3 | 0.2 | 3.8 |
| BV403N (5880) | 0.4 | 0.3 | 4.0 |
| Nonmetalized Acid | | | |

TABLE IV-continued

| Sample (winding speed) | Fastness Properties Three Color Averages Ozone | $NO_x$ | Xenon |
|---|---|---|---|
| Dyes | | | |
| No UV Stabilizer | | | |
| BS403F (4180) | 3.8 | 2.0 | 18.3 |
| BV403N (4180) | 3.9 | 1.5 | 12.4 |
| BS403F (4980) | 3.9 | 1.9 | 18.3 |
| BV403N (4980) | 3.6 | 1.4 | 11.9 |
| BS403F (5880) | 4.0 | 1.8 | 18.3 |
| BV403N (5880) | 3.7 | 1.5 | 12.4 |
| 1.5% UV Stabilizer | | | |
| BS403F (4180) | 3.3 | 1.6 | 13.4 |
| BV403N (4180) | 3.4 | 1.3 | 12.5 |
| BS403F (4980) | 3.2 | 1.3 | 13.9 |
| BV403N (4980) | 3.3 | 1.3 | 12.1 |

TABLE IV-continued

| Sample (winding speed) | Fastness Properties Three Color Averages Ozone | $NO_x$ | Xenon |
|---|---|---|---|
| BS403F (5880) | 3.7 | 1.5 | 14.3 |
| BV403N (5880) | 3.4 | 1.3 | 12.4 |

The invention shows a significant improvement in dye lightfastness relative to conventional dyed fibers, even when the stabilizer is omitted.

Figure 5:
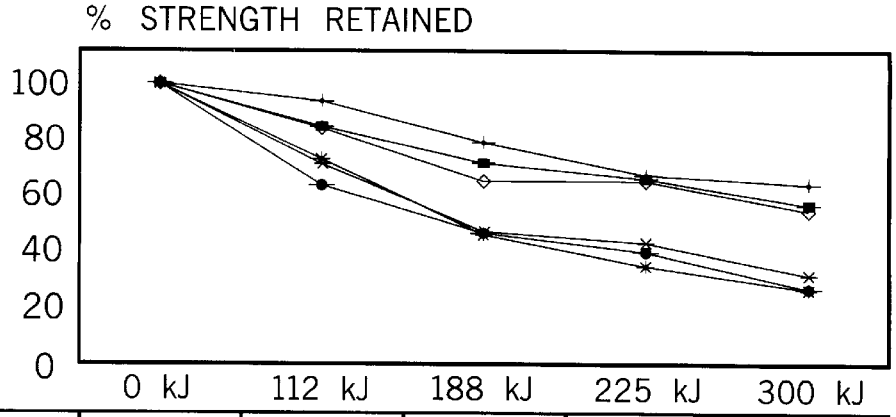
FIG. 5 is a graph depicting the comparative strength retention after xenon light exposure of fibers dyed with metalized acid dyes made according to the present invention versus conventional fibers.
Figure 6:
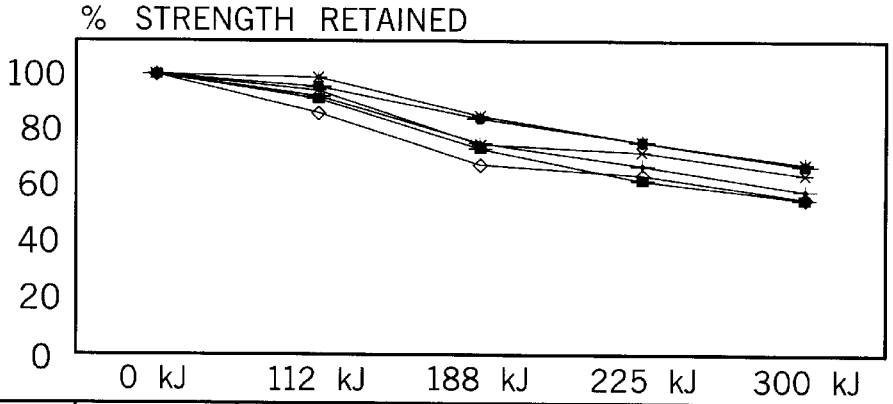
FIG. 6 is a graph depicting the strength retention after xenon light exposure of fibers dyed with metalized acid dyes with a U.V. stabilizer in the dyebath.
Figure 7:
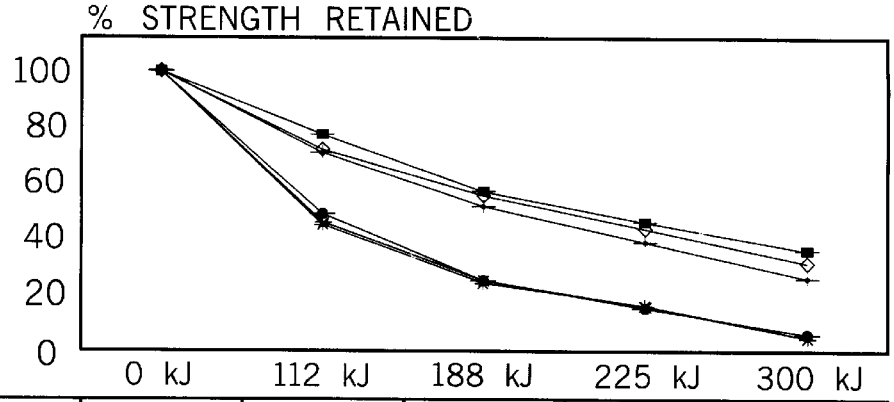
FIG. 7 is a graph depicting the comparative strength retention after xenon light exposure of fibers dyed with nonmetalized acid dyes made according to the present invention versus conventional fibers.
Figure 8:
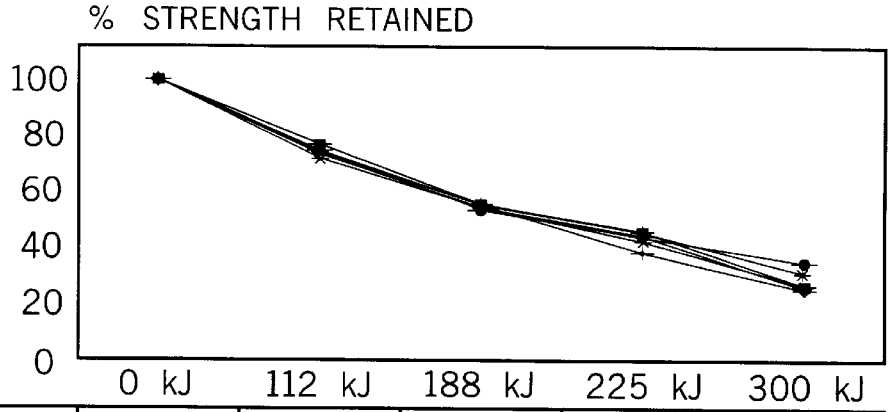
FIG. 8 is a graph depicting the strength retention after xenon light exposure of fibers dyed with nonmetalized acid dyes with a U.V. stabilizer in the dyebath.

Results for strength retention after xenon light exposures are given in Table V. Results for strength retention after xenon light exposure are shown graphically in FIGS. 5–8. The invention shows significant improvement over conventional fibers in strength(without the use of a stabilizer) when using either metalized acid or acid dyes.

TABLE V

Strength Retention After Xenon Exposures Metalized Acid Dyes - No UV Stabilizer

| | | | 112 kJ | | | 188 kJ | | | 225 kJ | | | 300 kJ | | |
|---|---|---|---|---|---|---|---|---|---|---|---|---|---|---|
| Sample | Winding Speed | Orig Str. | Str. | % Str. Retain | 3 Color Avg. | Str. | % Str. Retain | 3 Color Avg. | Str. | % Str. Retain | 3 Color Avg. | Str. | % Str. Retain | 3 Color Avg. |
| Spruce | | | | | | | | | | | | | | |
| BS403F | 4180 | 3.9 | 2.7 | 69.2 | 62.3 | 2.2 | 56.4 | 46.2 | 1.8 | 46.2 | 40.0 | 1.1 | 28.2 | 269 |
| BV403N | 4180 | 3.5 | 3.5 | 100.0 | 93.3 | 2.7 | 77.1 | 79.6 | 2.1 | 60.0 | 67.8 | 2.1 | 60.0 | 62.7 |
| BS403F | 4980 | 3.8 | 3.0 | 78.2 | 73.2 | 2.2 | 57.9 | 47.8 | 1.8 | 47.4 | 36.6 | 1.0 | 26.3 | 27.1 |
| BV403N | 4980 | 4.1 | 3.1 | 75.6 | 82.9 | 2.7 | 65.6 | 71.4 | 2.5 | 61.0 | 65.7 | 2.1 | 51.2 | 58.3 |
| BS403F | 5880 | 3.3 | 2.9 | 87.9 | 71.9 | 2.2 | 66.7 | 49.2 | 1.9 | 57.6 | 41.7 | 1.3 | 39.4 | 33.9 |
| BV403N | 5880 | 4.1 | 3.1 | 75.6 | 83.0 | 2.5 | 61.0 | 69.3 | 2.3 | 56.1 | 62.9 | 2.1 | 51.2 | 57.2 |
| Grey | | | | | | | | | | | | | | |
| BS403F | 4180 | 3.6 | 1.2 | 33.3 | | 0.4 | 11.1 | | 0.2 | 5.6 | | 0.0 | 0.0 | |
| BV403N | 4180 | 4.0 | 3.2 | 80.0 | | 2.9 | 72.5 | | 2.6 | 65.0 | | 2.2 | 55.0 | |
| BS403F | 4980 | 3.9 | 2.2 | 56.4 | | 0.6 | 15.4 | | 0.0 | 0.0 | | 0.0 | 0.0 | |
| BV403N | 4980 | 4.2 | 3.5 | 83.3 | | 2.8 | 66.7 | | 2.6 | 61.9 | | 2.4 | 57.1 | |
| BS403F | 5880 | 3.9 | 1.4 | 35.9 | | 0.2 | 5.1 | | 0.0 | 0.0 | | 0.0 | 0.0 | |
| BV403N | 5880 | 4.1 | 3.5 | 85.4 | | 2.9 | 70.7 | | 2.6 | 63.4 | | 2.4 | 58.5 | |
| Burgundy | | | | | | | | | | | | | | |
| BS403F | 4180 | 3.8 | 3.2 | 84.2 | | 2.7 | 71.1 | | 2.6 | 68.4 | | 2.0 | 52.6 | ( |
| BV403N | 4180 | 3.7 | 3.7 | 100.0 | | 3.3 | 89.2 | | 2.9 | 78.4 | | 2.7 | 73.0 | |
| BS403F | 4980 | 4.0 | 3.4 | 85.0 | | 2.8 | 70.0 | | 2.5 | 62.5 | | 2.2 | 55.0 | |
| BV403N | 4980 | 3.9 | 3.5 | 89.7 | | 3.2 | 82.1 | | 2.9 | 74.4 | | 2.6 | 66.7 | |
| BS403F | 5880 | 3.7 | 3.4 | 91.9 | | 2.8 | 75.7 | | 2.5 | 67.6 | | 2.3 | 62.2 | |
| BV403N | 5880 | 4.2 | 3.7 | 88.1 | | 3.2 | 76.2 | | 2.9 | 69.0 | | 2.6 | 61.9 | |
| Spruce | | | | | | | | | | | | | | |
| BS403F | 4180 | 3.9 | 1.5 | 38.5 | 49.2 | 0.4 | 10.3 | 25.5 | 0.2 | 5.1 | 16.7 | 0.0 | 0.0 | 6.1 |
| BV403N | 4180 | 4.2 | 2.7 | 64.3 | 70.1 | 1.9 | 45.2 | 50.8 | 1.6 | 38.1 | 39.0 | 1.1 | 26.2 | 26.5 |
| BS403F | 4980 | 3.9 | 1.3 | 33.3 | 46.0 | 0.4 | 10.3 | 24.6 | 0.2 | 5.1 | 17.8 | 0.0 | 0.0 | 5.8 |
| BV403N | 4980 | 3.8 | 2.8 | 73.7 | 77.1 | 2.0 | 51.8 | 55.8 | 1.7 | 44.7 | 45.5 | 1.4 | 36.8 | 34.1 |
| BS403F | 5880 | 4.0 | 1.2 | 30.0 | 47.2 | 0.4 | 10.0 | 25.6 | 0.2 | 5.0 | 17.8 | 0.0 | 0.0 | 7.6 |
| BV403N | 5880 | 4.1 | 2.8 | 68.3 | 71.5 | 2.2 | 53.7 | 56.1 | 1.6 | 39.0 | 43.1 | 1.3 | 31.7 | 30.9 |
| Grey | | | | | | | | | | | | | | |
| BS403F | 4180 | 3.8 | 2.5 | 65.8 | | 1.7 | 44.7 | | 1.2 | 31.6 | | 0.7 | 18.4 | |
| BV403N | 4180 | 4.1 | 3.1 | 75.6 | | 2.4 | 58.5 | | 1.8 | 43.9 | | 1.3 | 31.7 | |
| BS403F | 4980 | 4.0 | 2.5 | 62.5 | | 1.7 | 42.5 | | 1.3 | 32.5 | | 0.7 | 17.5 | |
| BV403N | 4980 | 3.9 | 3.3 | 84.6 | | 2.4 | 61.5 | | 2.0 | 51.3 | | 1.5 | 38.5 | |
| BS403F | 5880 | 4.1 | 2.7 | 65.9 | | 1.8 | 43.9 | | 1.4 | 34.1 | | 0.7 | 17.1 | |
| BV403N | 5880 | 4.1 | 3.3 | 80.5 | | 2.7 | 65.9 | | 2.2 | 53.7 | | 1.7 | 41.5 | |

TABLE V-continued

Strength Retention After Xenon Exposures Metalized Acid Dyes - No UV Stabilizer

| | | | 112 kJ | | | 188 kJ | | | 225 kJ | | | 300 kJ | | |
|---|---|---|---|---|---|---|---|---|---|---|---|---|---|---|
| Sample | Winding Speed | Orig Str. | Str. | % Str. Retain | 3 Color Avg. | Str. | % Str. Retain | 3 Color Avg. | Str. | % Str. Retain | 3 Color Avg. | Str. | % Str. Retain | 3 Color Avg. |
| Burgundy | | | | | | | | | | | | | | |
| BS403F | 4180 | 3.7 | 1.6 | 43.2 | | 0.8 | 21.6 | | 0.5 | 13.5 | | 0.0 | 0.0 | |
| BV403N | 4180 | 3.7 | 2.6 | 70.3 | | 1.8 | 48.6 | | 1.3 | 35.1 | | 0.8 | 21.6 | |
| BS403F | 4980 | 3.8 | 1.6 | 42.1 | | 0.8 | 21.1 | | 0.6 | 15.8 | | 0.0 | 0.0 | |
| BV403N | 4980 | 3.7 | 2.7 | 73.0 | | 2.0 | 54.1 | | 1.5 | 40.5 | | 1.0 | 27.0 | |
| BS403F | 5880 | 3.5 | 1.6 | 45.7 | | 0.8 | 22.9 | | 0.5 | 14.3 | | 0.2 | 5.7 | |
| BV403N | 5880 | 4.1 | 2.7 | 65.9 | | 2.0 | 48.8 | | 1.5 | 36.6 | | 0.8 | 19.5 | |
| Spruce | | | | | | | | | | | | | | |
| BS403F | 4180 | 4.0 | 3.6 | 90.0 | 95.7 | 3.1 | 77.5 | 82.7 | 2.7 | 67.5 | 77.6 | 2.4 | 60.0 | 67.3 |
| BV403N | 4180 | 3.6 | 3.3 | 91.7 | 92.1 | 2.7 | 75.0 | 76.0 | 2.5 | 69.4 | 68.9 | 2.1 | 58.3 | 59.1 |
| BS403F | 4980 | 3.6 | 3.5 | 97.2 | 99.0 | 2.9 | 80.6 | 83.7 | 2.7 | 75.0 | 77.4 | 2.4 | 66.7 | 68.5 |
| BV403N | 4980 | 3.5 | 3.3 | 94.3 | 90.9 | 2.8 | 80.0 | 74.8 | 2.1 | 60.0 | 61.6 | 2.1 | 60.0 | 56.0 |
| BS403F | 5880 | 3.5 | 3.3 | 94.3 | 93.0 | 2.7 | 77.1 | 74.4 | 2.4 | 68.6 | 71.1 | 2.2 | 62.9 | 65.8 |
| BV403N | 5880 | 4.1 | 3.4 | 82.9 | 86.9 | 2.6 | 63.4 | 68.8 | 2.4 | 58.5 | 63.8 | 2.2 | 53.7 | 56.3 |
| Grey | | | | | | | | | | | | | | |
| BS403F | 4180 | 3.7 | 3.4 | 91.9 | | 2.9 | 78.4 | | 2.8 | 75.7 | | 2.4 | 64.9 | |
| BV403N | 4180 | 3.9 | 3.2 | 82.1 | | 2.7 | 69.2 | | 2.4 | 61.5 | | 1.9 | 48.7 | |
| BS403F | 4980 | 3.7 | 3.6 | 97.3 | | 2.7 | 73.0 | | 2.5 | 67.6 | | 2.1 | 56.8 | |
| BV403N | 4980 | 4.2 | 3.4 | 81.0 | | 2.5 | 59.5 | | 2.2 | 52.4 | | 1.8 | 42.9 | |
| BS403F | 5880 | 3.9 | 3.4 | 87.2 | | 2.3 | 58.2 | | 2.6 | 66.7 | | 2.3 | 59.0 | |
| BV403N | 5880 | 3.9 | 3.4 | 87.2 | | 2.6 | 66.7 | | 2.4 | 61.5 | | 1.9 | 48.7 | |
| Burgundy | | | | | | | | | | | | | | |
| BS403F | 4180 | 3.9 | 4.1 | 105.1 | | 3.6 | 92.3 | | 3.5 | 89.7 | | 3.0 | 76.9 | |
| BV403N | 4180 | 3.7 | 3.8 | 102.7 | | 3.1 | 83.8 | | 2.8 | 75.7 | | 2.6 | 70.3 | |
| BS403F | 4980 | 3.9 | 4.0 | 102.6 | | 3.8 | 97.4 | | 3.5 | 89.7 | | 3.2 | 82.1 | |
| BV403N | 4980 | 4.0 | 3.9 | 97.5 | | 3.4 | 85.0 | | 2.9 | 72.5 | | 2.6 | 65.0 | |
| BS403F | 5880 | 4.1 | 4.0 | 97.6 | | 3.6 | 87.8 | | 3.2 | 78.0 | | 3.1 | 75.6 | |
| BV403N | 5880 | 4.2 | 3.8 | 90.5 | | 3.2 | 76.2 | | 3.0 | 71.4 | | 2.8 | 66.7 | |
| Spruce | | | | | | | | | | | | | | |
| BS403F | 4180 | 4.0 | 3.0 | 75.0 | 73.8 | 2.5 | 62.5 | 52.9 | 2.1 | 52.5 | 44.1 | 1.6 | 40.0 | 33.0 |
| BV403N | 4180 | 3.8 | 2.9 | 76.3 | 74.1 | 2.2 | 57.9 | 55.6 | 1.4 | 36.8 | 39.5 | 0.9 | 23.7 | 26.0 |
| BS403F | 4980 | 3.8 | 2.9 | 76.3 | 73.2 | 2.4 | 63.2 | 55.5 | 1.9 | 50.0 | 44.9 | 1.5 | 39.5 | 30.8 |
| BV403N | 4980 | 3.5 | 2.8 | 80.0 | 77.9 | 2.0 | 57.1 | 56.7 | 1.7 | 48.6 | 46.1 | 1.0 | 28.6 | 27.5 |
| BS403F | 5880 | 4.1 | 2.9 | 70.7 | 71.9 | 2.3 | 56.1 | 54.7 | 2.0 | 48.8 | 42.3 | 1.3 | 31.7 | 28.7 |
| BV403N | 5880 | 4.2 | 2.9 | 69.0 | 72.7 | 2.2 | 52.4 | 54.5 | 1.8 | 42.9 | 44.6 | 1.1 | 26.2 | 28.1 |
| Grey | | | | | | | | | | | | | | |
| BS403F | 4180 | 4.0 | 3.3 | 82.5 | | 2.4 | 60.0 | | 2.3 | 57.5 | | 1.8 | 45.0 | |
| BV403N | 4180 | 4.0 | 3.2 | 80.0 | | 2.6 | 65.0 | | 2.0 | 50.0 | | 1.3 | 32.5 | |
| BS403F | 4980 | 4.1 | 3.3 | 80.5 | | 2.6 | 63.4 | | 2.3 | 56.1 | | 1.7 | 41.5 | |
| BV403N | 4980 | 3.9 | 3.4 | 87.2 | | 2.5 | 64.1 | | 2.1 | 53.8 | | 1.3 | 33.3 | |
| BS403F | 5880 | 4.0 | 3.4 | 85.0 | | 2.6 | 65.0 | | 2.1 | 52.5 | | 1.6 | 40.0 | |
| BV403N | 5880 | 4.0 | 3.3 | 82.5 | | 2.6 | 65.0 | | 2.2 | 55.0 | | 1.5 | 37.5 | |
| Burgundy | | | | | | | | | | | | | | |
| BS403F | 4180 | 3.6 | 2.3 | 63.9 | | 1.3 | 36.1 | | 0.8 | 22.2 | | 0.5 | 13.9 | |
| BV403N | 4180 | 4.1 | 2.7 | 65.9 | | 1.8 | 43.9 | | 1.3 | 31.7 | | 0.9 | 22.0 | |
| BS403F | 4980 | 3.5 | 2.2 | 62.9 | | 1.4 | 40.0 | | 1.0 | 28.6 | | 0.4 | 11.4 | |
| BV403N | 4980 | 3.9 | 2.6 | 66.7 | | 1.9 | 48.7 | | 1.4 | 35.9 | | 0.8 | 20.5 | |
| BS403F | 5880 | 3.5 | 2.1 | 60.0 | | 1.5 | 42.9 | | 0.9 | 25.7 | | 0.5 | 14.3 | |
| BV403N | 5880 | 3.9 | 2.6 | 66.7 | | 1.8 | 46.2 | | 1.4 | 35.9 | | 0.8 | 20.5 | |

EXAMPLE 2

Four 1100/68 bright, trilobal cross section polyamide yarns are prepared by conventional polyamide melt spinning techniques. The yarns are prepared from nylon-6 polymers regulated (terminated) with 0.095 wt % benzoic add (Sample 2BA), 0.15 wt % propionic add (Sample 2PA), 0.13 wt % terephthalic add (Sample 2TPA) and 0.30 wt % terephthalic acid plus 0.15 wt % triacetone diamine [4Amino-2,2-6,6, tertamethyl piperidine] (Sample 2TPA/TAD) The yarns are knitled into tubes and scoured for 20 minutes at 75° C. with the following additives:

20:1 bath ratio, demineralized water 0.5 grams/liter Kieralon(® NB-OL (anionic and nonionic surfactant commercially available from BASF Corporation, Mt Olive, N.J.)

0.5 grams/liter TSPP (tetrasodium pyrophosphate)

Each tube is then dyed in a separate dyebath taken from a master bath which contained the following:

30:1 bath ratio, demineralized water 2.0% o.w.f Uniperol® NB-SE (an oxyethylene leveling agent commercially available from BASF Corporation, Mt Olive, N.J.)

2.0% o.w.f. Eulysin®WP (a low volatility organic ester for pH control commercially available from BASF Corporation)

0.005% Irgalan® Red B-K 200% (C.I. Add Red 182)

0.125% Irgalan® Black BGL 200% (C.I. Acid Black 107)

0.030% Irgalan® Yellow 3RL 250% (C.I. Acid Orange 162) (Lanasyn® and Irgalan® dyestuffs are commercially available from Sandoz Chemicals Corporation of Charlotte, N.C., and Ciba Corporation of Greensboro, N.C., respectively.)

The initial dyebath pH is adjusted to 10.0 with soda ash. In the dyebath, samples are heated to 95° C. over 30 minutes and held at 95° C. for 30 minutes. The dyebath is cooled. The Eulysin® WP brings the pH down to 6–7 during the dyeing. The samples are then removed from the dyebath, rinsed in warm water, then in cold water and dried. Sections of each dyed tube are exposed to 112.8 kJ of xenon light by SAE Test Method J1885. Delta E (total color change) values compared to a dyed, unexposed sample for each type of yarn is presented in Table VI.

TABLE VI

| Sample | ΔE |
|---|---|
| 2BA | 18.2 |
| 2PA | 16.0 |
| 2TPA | 17.5 |
| 2TPA/TAD | 3.5 |

EXAMPLE 3

Four polyamide yarns are prepared as described in Example 2. Each yarn is steam heatset by conventional means used for carpet yarn. Each yarn is scoured and dyed as in Example 2, except the following blue shade is used in dyeing.

0.013% Irgalan® Bordeaux EL 200% (C.I. Acid Red 251)

0.049% Irgalan® Blue 3GL (C.I. Acid Blue 171)

0.026% Irgalan® Grey GL 200% (C.I. Acid Black 131:1)

0.002% Lanacron® Brown S-GL (C.I. Acid Brown 298)

Sections of each dyed tube are exposed to 112.8 kJ of xenon light by SAE Test Method J1885. Delta E values are presented in Table VII

TABLE VII

| Sample | ΔE |
|---|---|
| 3BA | 23.3 |
| 3PA | 21.0 |
| 3TPA | 21.7 |
| 3TPA/TAD | 11.5 |

What is claimed is:

1. A photochemically stabilized nylon article comprising an article shaped from a polymer formed by hydrolytically polymerizing epsilon-caprolactam in the presence of water and at least one hindered piperidine derivative selected from the group consisting of:

3 amino-2,2',6,6'-tetramethylpiperidine:

4 amino-2,2',6,6'-tetramethylpiperidine;

4-(aminoalkyl)-2,2',6,6'-tetramethylpiperidine;

4-(aminoaryl)-2,2',6,6'-tetramethylpiperidine;

3-(aminoalkyl)-2,2',6,6'-tetramethylpiperidine;

3-(aminoaryl)-2,2',6,6'-tetramethylpiperidine;

2,2',6,6'-tetramethyl-4-piperidinealkylcarboxylic acid;

2,2',6,6'-tetramethyl-4-piperidinearylcarboxylic acid;

2,2',6,6'-tetramethyl-3-piperidinealkylcarboxylic acid; and 2,2',6,6'-tetramethyl-3-piperidinearylcarboxylic acid; and dyed with at least one metalized acid or with at least one nonmetalized acid dyestuff.

2. The article of claim 1 wherein said article is in the shape of a fiber, film or molded article.

3. The article of claim 1 wherein said polymer is formed in the presence of a carboxylic acid chain regulator selected from the group consisting of:

acetic acid;

propionic acid;

benzoic acid;

cyclohexane-1,4-dicarboxylic acid;

naphthalene-2,6-dicarboxylic acid;

terephthalic acid;

isophthalic acid; and combinations thereof; and a hindered piperidine carboxylic acid derivative.

4. The article of claim 1 wherein said hindered piperidine derivative is an aminopolyalkylamine.

5. The article of claim 4 wherein said hindered piperidine derivative is selected from the group consisting of:

4-amino-2,2',6,6'-tetramethylpiperidine;

3-amino-2,2',6,6'-tetramethylpiperidine;

2,2',6,6'-tetramethyl-4-piperidinecarboxylic acid; and 2,2',6,6'-tetramethyl-3-piperidinecarboxylic acid.

6. The article of claim 1 wherein the nonmetalized acid dyestuff is selected from the group consisting of:

C.I. Acid Yellow 246;

C.I. Acid Orange 156:

C.I. Acid Red 361;

C.I. Acid Blue 277; and

C.I. Acid Blue 324.

7. The article of claim 1 wherein said metalized acid dyestuff is selected from the group consisting of:

C.I Acid Yellow 59;

C.I. Acid Orange 162;

C.I. Acid Red 51;

C.I. Acid Blue 171;

C.I. Acid Brown 298;

C.I. Acid Black 131:1; and

C.I. Acid Black 132.

8. The article of claim 2 wherein said article is a fiber.

9. The article of claim 3 wherein said hindered piperidine derivative is an aminopolyalkylamine.

10. The article of claim 9 wherein said hindered piperidine is selected from the group consisting of:

4-amino-2,2',6,6'-tetramethylpiperidine;

3-amino-2,2',6,6'-tetramethylpiperidine;

2,2',6,6'-tetramethyl-4-piperidinecarboxylic acid; and 2,2',6,6'-tetramethyl-3-piperidinecarboxylic acid.

11. The article of claim 3 wherein the nonmetalized acid dyestuff is selected from the group consisting of:

C.I. Acid Yellow 246;

C.I. Acid Orange 156;

C.I. Acid Red 361;

C.I. Acid Blue 277; and

C.I. Acid Blue 324.

12. The article of claim 3 wherein said metalized acid dyestuff is selected from the group consisting of:

C.I. Acid Yellow 59;

C.I. Acid Orange 162;

C.I. Acid Red 51;

C.I. Acid Blue 171;

C.I. Acid Brown 298;

C.I. Acid Black 131:1; and

C.I. Acid Black 132.

* * * * *